US008601969B2

(12) United States Patent
Watanabe et al.

(10) Patent No.: US 8,601,969 B2
(45) Date of Patent: Dec. 10, 2013

(54) FLOAT DEVICE

(75) Inventors: Kazuhiro Watanabe, Yokohama (JP); Nobuyuki Shikama, Yokosuka (JP); Keisuke Mizuno, Yokosuka (JP)

(73) Assignees: The Tsurumi Seiki Co., Ltd., Yokohama-shi (JP); Japan Agency for Marine-Earth Science and Technology, Yokosuka-shi (JP)

( * ) Notice: Subject to any disclaimer, the term of this patent is extended or adjusted under 35 U.S.C. 154(b) by 49 days.

(21) Appl. No.: 13/456,260

(22) Filed: Apr. 26, 2012

(65) Prior Publication Data

US 2012/0204775 A1 Aug. 16, 2012

Related U.S. Application Data

(63) Continuation of application No. PCT/JP2010/069089, filed on Oct. 27, 2010.

(30) Foreign Application Priority Data

Oct. 27, 2009 (JP) ..... 2009-246472

(51) Int. Cl.
*B63G 8/00* (2006.01)

(52) U.S. Cl.
USPC ..... 114/312; 114/121; 73/170.29; 73/170.33; 73/170.34

(58) Field of Classification Search
USPC ..... 114/121, 312; 73/170.29, 170.33, 73/170.34
See application file for complete search history.

(56) References Cited

U.S. PATENT DOCUMENTS

| | | | | | |
|---|---|---|---|---|---|
| 3,225,593 | A | * | 12/1965 | Richard | 73/170.31 |
| 4,191,049 | A | * | 3/1980 | Bowditch et al. | 73/170.11 |
| 4,220,044 | A | * | 9/1980 | LeBlanc et al. | 73/170.01 |
| 4,777,819 | A | * | 10/1988 | Hoyt et al. | 73/170.34 |
| 5,046,359 | A | * | 9/1991 | Layport | 73/170.33 |
| 5,283,767 | A | * | 2/1994 | McCoy | 367/4 |

(Continued)

FOREIGN PATENT DOCUMENTS

| | | | |
|---|---|---|---|
| JP | 62-187692 | A | 8/1987 |
| JP | 2002-145177 | A | 5/2002 |

(Continued)

OTHER PUBLICATIONS

International Search Report mailed Jan. 18, 2011, issued in corresponding International Application No. PCT/JP2010/069089, filed Oct. 27, 2010, 2 pages.

(Continued)

*Primary Examiner* — Lars A Olson
*Assistant Examiner* — Jovon Hayes
(74) *Attorney, Agent, or Firm* — Christensen O'Connor Johnson Kindness PLLC

(57) ABSTRACT

A float device includes a drive motor provided inside a float hull, a plunger reciprocating along with rotation of the drive motor, an internal oil reservoir for housing an hydraulic oil therein, an externally-opened cylinder attached to the float hull, a buoyant force adjustment piston reciprocating in the cylinder along with exit/entry of the hydraulic oil, and a three-way valve having a first connection port connected to the plunger, a second connection port connected to the internal oil reservoir, and a third connection per connected to the cylinder, for switching the flow between the first connection port and the second connection ports and the flow between the first connection port and the third connection port.

12 Claims, 4 Drawing Sheets

(56) References Cited

U.S. PATENT DOCUMENTS

| | | | | |
|---|---|---|---|---|
| 5,663,927 | A * | 9/1997 | Olson et al. | 367/4 |
| 5,792,950 | A * | 8/1998 | Shonting | 73/170.34 |
| 6,807,856 | B1 * | 10/2004 | Webb | 73/170.29 |
| 7,221,171 | B2 * | 5/2007 | Sohl et al. | 324/755.09 |
| 7,258,836 | B2 * | 8/2007 | Hill et al. | 422/50 |
| 7,278,293 | B2 * | 10/2007 | Sierra et al. | 73/53.01 |
| 7,874,886 | B2 * | 1/2011 | Fowler et al. | 441/11 |
| 8,038,937 | B2 * | 10/2011 | Kelly et al. | 422/6 |
| 2008/0087209 | A1 | 4/2008 | Yoshida | |
| 2012/0204775 | A1 * | 8/2012 | Watanabe et al. | 114/56.1 |

FOREIGN PATENT DOCUMENTS

| | | | |
|---|---|---|---|
| JP | 2003-127974 | A | 5/2003 |
| JP | 2009-515100 | A | 4/2009 |
| WO | 2006/070577 | A1 | 7/2006 |
| WO | 2007/051502 | A1 | 5/2007 |

OTHER PUBLICATIONS

Kobayashi, T., et al., "Deep NINJA: A New Float for Deep Ocean Observation Developed in Japan," IEEE Symposium on Underwater Technology (UT) and Workshop on Scientific Use of Submarine Cables and Related Technologies (SSC), Tokyo, Apr. 5-8, 2011, 7 pages.

Kobayashi, T., et al., "Deep NINJA: A New Float for Deep Ocean Observation Developed in Japan," Conference Presentation, Oceans '11 MTS/IEEE, Kona, Hawaii, Sep. 19-22, 2011, 8 pages.

Kobayashi, T., et al., "New Buoyancy Engine for Autonomous Vehicles Observing Deeper Oceans," Proceedings of the 20th International Offshore and Polar Engineering Conference, Beijing, Jun. 20-25, 2010, 5 pages.

International Preliminary Report on Patentability mailed Jun. 12, 2012, issued in corresponding International Application No. PCT/JP2010/069089, filed Oct. 27, 2010, 5 pages.

* cited by examiner

FLOAT DEVICE

CROSS REFERENCE TO RELATED APPLICATIONS

This application is a Continuation Application of PCT Application No. PCT/JP2010/069089, filed Oct. 27, 2010 and based upon and claiming the benefit of priority from prior Japanese Patent Application No. 2009-246472, filed Oct. 27, 2009, the entire contents of all of which are incorporated herein by reference.

BACKGROUND OF THE INVENTION

1. Field of the Invention

The present invention relates to a float device such as ocean observation float device, which is called a "profiling float" used for an ocean monitoring system (which will be called Argo program below), and particularly to a technique capable of reducing the number of parts and adjusting a buoyant force with high accuracy.

2. Description of the Related Art

In order to address the environmental problems such as global warming, it is necessary to reveal environmental variation mechanisms in the global environment and to determine the total amount and the circulation of greenhouse gas. The Argo program is being promoted in order to address the problems. Under the Argo program a cylinder-shaped ocean observation float device having a length of 1 m which is called a "profiling float" is deployed from a ship, then automatically descends up to a depth (about 2000 m) in balance with a preset density of around water, and drifts for several days. When the power supply is turned on by an internal timer, the ocean observation float device comprising a float hull having a certain buoyancy is raised by a buoyant force adjustment mechanism.

The ocean observation float device is ascending while measuring water temperature and salinity. The ocean observation float device floating on the sea surface is powered off after transmitting the observation data from the sea surface via satellites, and is caused to descend by the buoyant force adjustment mechanism. The operation is repeated for several years.

The above buoyant force adjustment mechanism is configured as follows, for example. That is, FIG. 4 is an explanatory diagram schematically snowing a buoyant force adjustment mechanism 100 for adjusting a buoyant force of an ocean observation float device by carrying hydraulic oil between an external buoyant force adjustment bladder and an internal oil reservoir. The buoyant force adjustment mechanism 100 comprises an internal oil reservoir 110 for storing hydraulic oil therein, a plunger 120 and an external buoyant force adjustment bladder 130, which are connected via oil pipes 140, 141 and 142. The oil pipes 140, 141 and 142 are provided with a check valve 150, a check valve 151 and a valve 152, respectively.

In the buoyant force adjustment mechanism 100, when the hydraulic oil is carried from the internal oil reservoir 110 to the external buoyant force adjustment bladder 130, the plunger 120 is moved in the arrow α direction In FIG. 4 while the valve 152 is closed, and the hydraulic oil is taken from the internal oil reservoir 110 into the plunger 120. At this time, the hydraulic oil cannot be sucked from the external buoyant force adjustment bladder 130 by the operation of the check valve 151. Then, the plunger 120 is moved in the arrow β direction in FIG. 4 and the hydraulic oil is supplied from the plunger 120 to the external buoyant force adjustment bladder 130. At this time, the hydraulic oil does not return to the internal oil reservoir 110 because of the operation of the check valve 150. When the external buoyant force adjustment bladder 130 swells in this way, the ocean observation float device ascends.

On the other hand, when the ocean observation float device descends, the hydraulic oil is returned from the external buoyant force adjustment bladder 130 to the internal of reservoir 110. In this case, the valve 152 is opened so that the hydraulic oil is returned to the internal oil reservoir 110 by a contraction force of the external buoyant force adjustment bladder 130.

BRIEF SUMMARY OF THE INVENTION

The above buoyant force adjustment mechanism has the following problems. That is, three valves are required, and thus the number of parts increases and the float hull can be increased in its size. The buoyant force adjustment mechanism can be controlled by the plunger during the ascent but cannot be controlled by the plunger during the descent, and thus there is a problem that the buoyant force is difficult to be controlled with high accuracy.

It is therefore an object of the present invention to provide a float device capable of reducing the number of parts and controlling a buoyant force with high accuracy during both ascent and descent.

The float device according to the present invention is configured as follows in order to meet the object.

A float device is characterized in that the float device comprises a float hull having a certain buoyancy, a drive motor provided inside the float hull, a plunger reciprocating along with rotation of the drive motor, an internal it reservoir for housing hydraulic oil therein, an externally-opened cylinder attached to the float hull, a buoyant force adjustment piston reciprocating in the cylinder along with exit/entry of the hydraulic oil, and a three-way valve having a first connection port connected to the plunger, a second connection port connected to the internal oil reservoir and a third connection port connected to the cylinder, for switching the flow between the first connection port and the second connection port and the flow between the first connection port and the third connection port.

A float device is characterized in that the float device comprises a float hull having a certain buoyancy, a drive motor provided inside the float hull, a plunger reciprocating along with rotation of the drive motor, an internal oil reservoir for housing an hydraulic oil therein, an externally-opened cylinder attached to the float hull, a buoyant force adjustment piston reciprocating in the cylinder along with exit/entry of the hydraulic oil, a branch pipe connected at the branch point to the plunger, a first two-way valve attached to one side of the branch pipe and connected to the internal oil reservoir, and a second two-way valve attached to the other side of the branch pipe and connected to the cylinder.

DETAILED DESCRIPTION OF THE INVENTION

Figure 1:
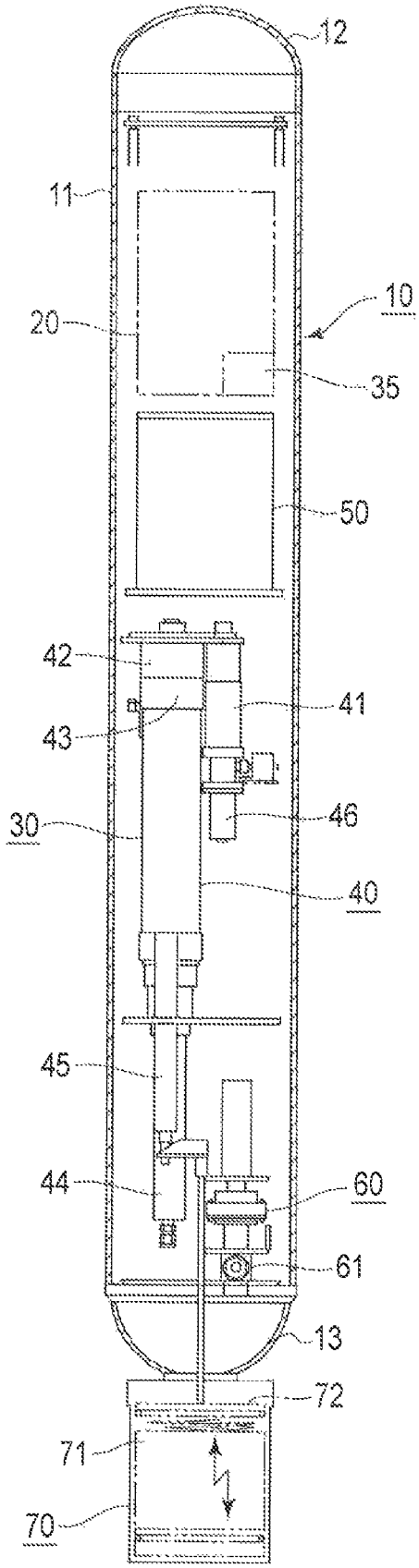
FIG. 1 is a longitudinal cross section view showing an ocean observation float device according to one embodiment of the present invention.
Figure 2:
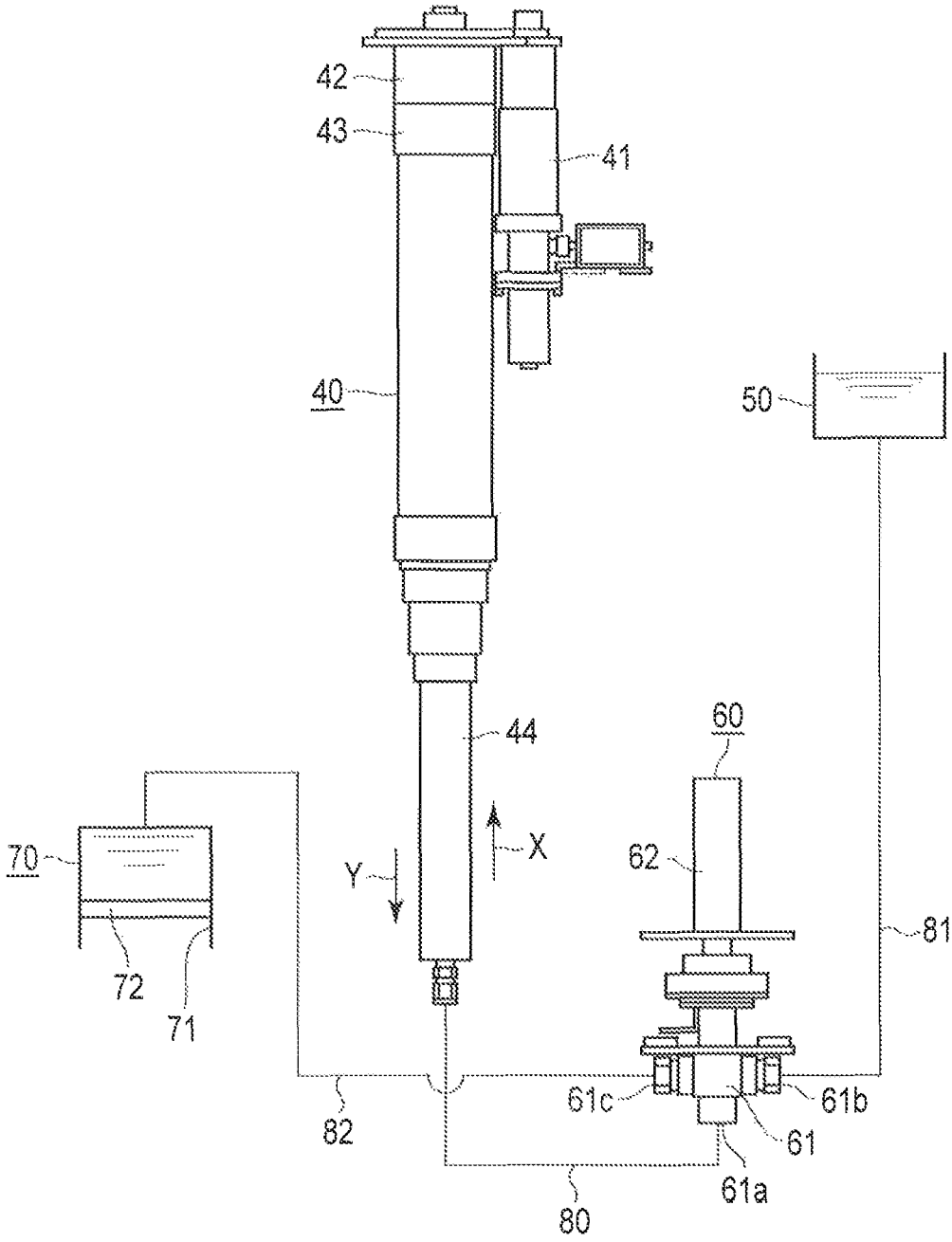
FIG. 2 is an explanatory diagram schematically showing a buoyant force adjustment mechanism incorporated in the ocean observation float device.

FIG. 1 is a diagram showing an ocean observation float device 10 according to one embodiment of the present invention, and FIG. 2 is an explanatory diagram schematically showing a buoyant force adjustment mechanism 30 incorporated in the ocean observation float device 10.

The ocean observation float device 10 comprises a float hull 11 formed in a cylinder-like shape. The float hull 11 is provided with a hollow or the like inside or outside, and is set to have a predetermined buoyant force. An electronic part mounting unit 20 mounting an antenna for transmission and reception with external communication devices, and various ocean observation electronic devices thereon is mounted on a top part 12 of the float hull 11. Part of the buoyant force adjustment mechanism 30 is mounted on a bottom part 13 of the float hull 11.

The buoyant force adjustment mechanism 30 comprises a plunger mechanism 40 arranged inside the float hull 11, an internal oil reservoir 50 for storing an hydraulic oil therein, a three-way valve mechanism 60, a buoyant force adjustment mechanism 70 provided outside the float hull 11, and a control unit 35 for controlling them in an associated manner. An oil pipe 80, an oil pipe 81, and an oil pipe 82 connect between the plunder mechanism 40 and the three-way valve mechanism 60, between the internal of reservoir 50 and the three-way valve mechanism 60, and between the buoyant force adjustment unit 70 and the three-way valve mechanism 60, respectively.

The plunger mechanism 40 comprises a drive motor 41, a deceleration mechanism 42 for transmitting a rotation force of the drive motor 41 while decelerating, a gear unit 43 for transforming the rotation force transmitted by the deceleration mechanism 42 into a reciprocating power, and a plunger 44 reciprocating by the gear unit 43.

The three-way valve mechanism 60 comprises a three-way valve 61, and an operation motor 62 for operating the three-way valve 61. The three-way valve 61 has a first connection port 61*a* connected to the plunger 44, a second connection port 61*b* connected to the internal oil reservoir 50, and a third connection port 61*c* connected to a cylinder 71 described later, and switches the flow between the first connection port 61*a* and the second connection port 61*b* and the flow between the first connection port 61*a* and the third connection port 61*c*.

The buoyant force adjustment unit 70 comprises an externally-opened cylinder (variable volume body) 71, and a buoyant force adjustment piston 72 reciprocating in the cylinder 71 along with exit/entry of the hydraulic oil.

The plunger mechanism 40 and the three-way valve mechanism 60 are controlled such that an associated operation is performed as follows. That is, the three-way valve 61 is switched to cause the first connection port 61*a* and the second connection port 61*b* to permit flow during the movement of the plunger 44 to one side, and the three-way valve 61 is switched to cause the first connection port 61*a* and the third connection port 61*c* to permit flow during the movement of the plunger 44 to the other side, thereby carrying the hydraulic oil between the internal oil reservoir 50 and the cylinder 71.

With the thus-configured ocean observation float device 10, a buoyant force is adjusted as follows. That is, the hydraulic oil is carried from the internal oil reservoir 50 to the cylinder 71 during the ascent. At first, the drive motor 41 is operated to move the plunger 44 in the X-direction in FIG. 2. At this time, the three-way valve 61 is switched to cause the first connection port 61*a* and the second connection port 61*b* to permit flow. Accordingly, the hydraulic oil is carried from the internal oil reservoir 50 to the plunger 44. Subsequently, the drive motor 41 is operated to move the plunger 44 in the Y-direction in FIG. 2. At this time, the three-way valve 61 is switched to cause the first connection port 61*a* and the third connection port 61*c* to permit flow. Accordingly, the hydraulic oil is carried from the plunger 44 to the cylinder 71 and the buoyant force adjustment piston 72 moves outward.

Accordingly, a buoyant force increases and the float hull 11 slightly ascends. The same operations are repeated so that the amount of hydraulic oil inside the cylinder 71 increases and the float hull 11 ascends to a predetermined position.

On the other hand, during the descent, the hydraulic oil is carried from the cylinder 71 to the internal oil reservoir 50. At first, the drive motor 41 is operated to move the plunger 44 in the X-direction in FIG. 2. At this time, the three-way valve 61 is switched to cause the first connection port 61*a* and the third connection port 61*c* to permit flow. Accordingly, the hydraulic oil is carried from the cylinder 71 to the plunger 44 and the buoyant force adjustment piston 72 moves inward. Accordingly, the buoyant force decreases. Subsequently, the drive motor 41 is operated to move the plunger 44 in the Y-direction in FIG. 2. At this time, the three-way valve 61 is switched to cause the first connection port 61*a* and the second connection port 61*b* to permit flow. Accordingly, the hydraulic oil is carried from the plunder 44 to the internal oil reservoir 50.

The same operations are repeated so that the amount of hydraulic oil inside the cylinder 71 decreases and the float hull 11 descends to a predetermined position.

With the ocean observation float device 10 according to the present embodiment, the transport of the hydraulic oil can be controlled only by the three-way valve 61, and thus the number of parts can be reduced and the float hull can be downsized. The float device can be controlled by the plunger 44 during both the ascent and the descent, and thus the buoyant force can be controlled with high accuracy, thereby positioning the float hull 11 at a desired position. Thus, the ocean data can be measured with high accuracy.

The position of the cylinder 71 is measured by an encoder 45 and the position of the plunger 44 is measured by an encoder 46 with high accuracy, and the positions may be input into the control unit 35 to be used as positioning information and buoyant force adjustment information. A potentiometer may be used instead of the encoder 45.

A bellows type bag or the like may be used as a variable volume body instead of the cylinder 71.

A working robot may be attached to the float hull 11 and may be used as an undersea robot.

Figure 3:
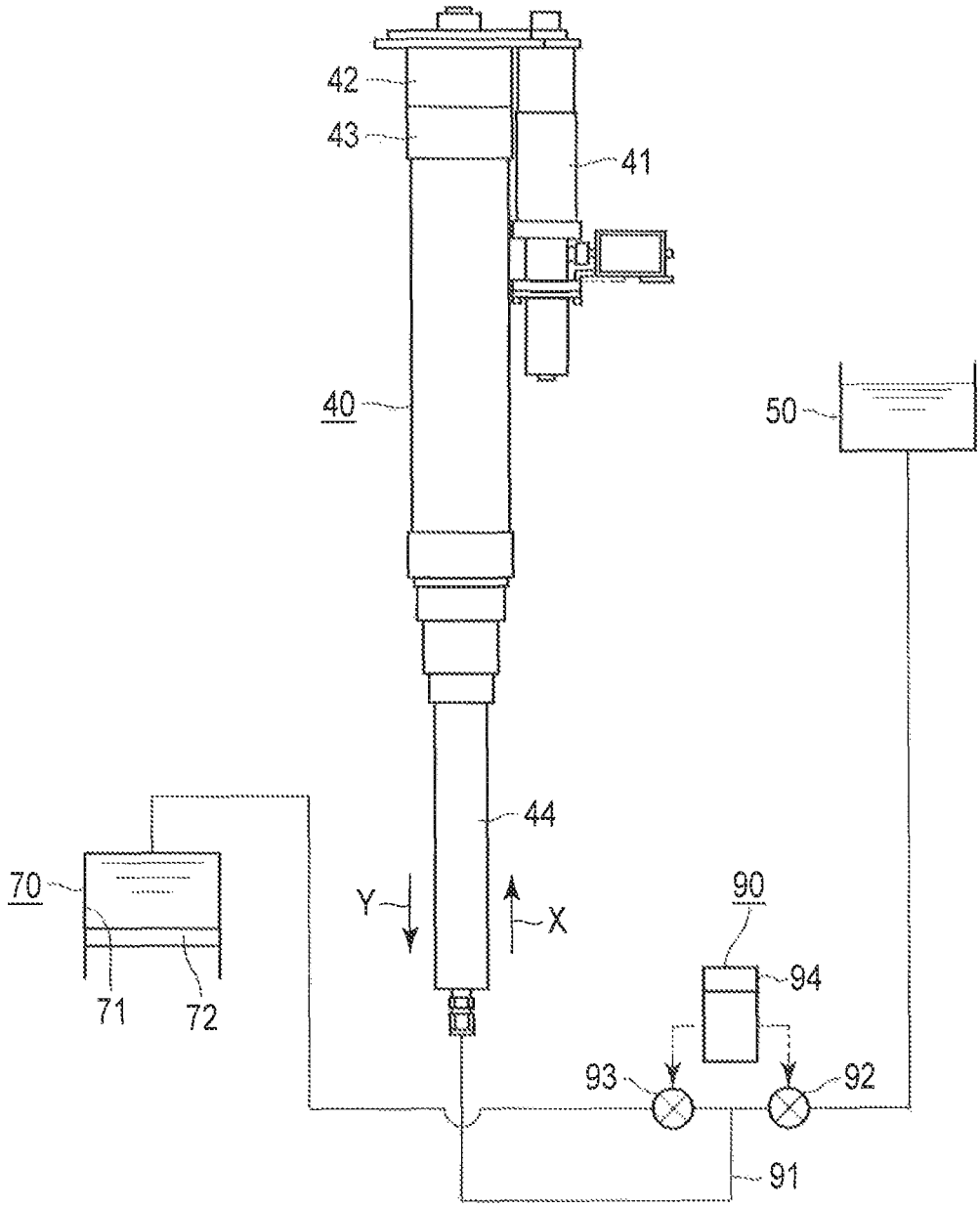
FIG. 3 is an explanatory diagram schematically showing a variant of the buoyant force adjustment mechanism.
Figure 4:
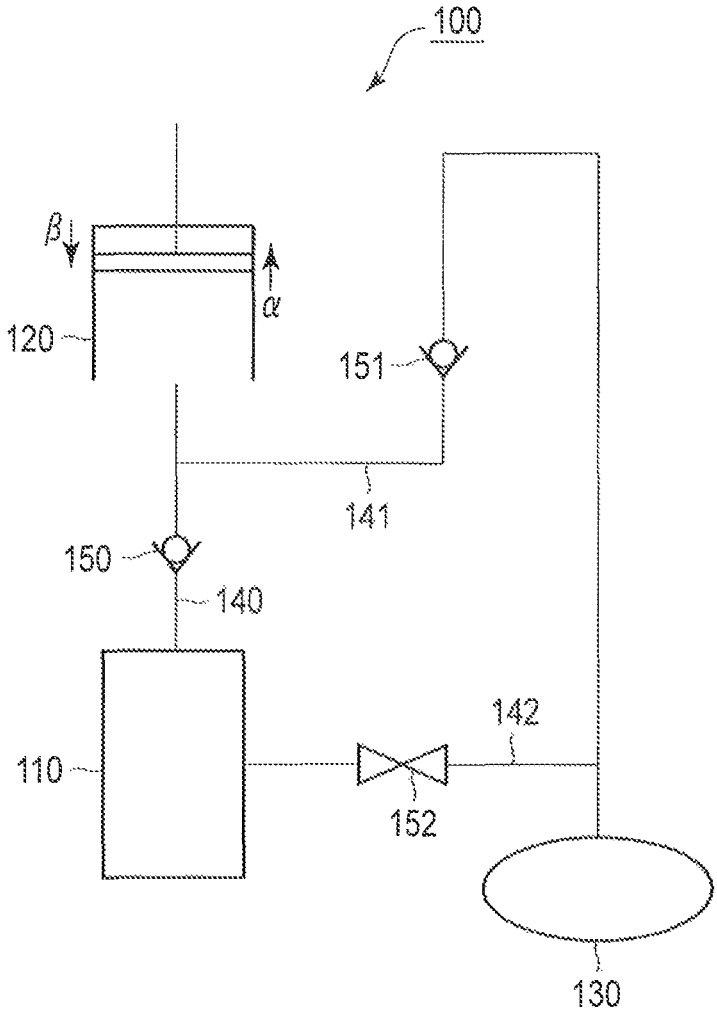
FIG. 4 is an explanatory diagram schematically showing an example of buoyant force adjustment mechanism.

FIG. 3 is an explanatory diagram schematically showing a structure of a buoyant force adjustment mechanism 30A according to a variant of the buoyant force adjustment mechanism 30. In FIG. 3, like reference numerals are denoted to the same parts as those in FIG. 2, and a detailed explanation thereof will be omitted.

In the present variant, a two-way valve mechanism 90 is provided instead of the three-way valve mechanism 60. The two-way valve mechanism 90 comprises a branch pipe 91 connected at the branch point to the plunger 44, a first two-way valve 92 attached to one side of the branch pipe 91 and connected to the internal oil reservoir 50, a second two-way valve 93 attached to the other side of the branch pipe 91 and connected to the cylinder 71, and an operation motor 94 for opening and closing the first two-way valve 92 and the second two-way valve 93.

The plunger mechanism 40 and the two-way valve mechanism 90 are controlled to perform an associated operation as follows. That is, the first two-way valve 92 is opened and the second two-way valve 93 is closed during the movement of the plunger 44 to one side and the first two-way valve 92 is closed and the second two-way valve 93 is opened during the movement of the plunger 44 to the other side, thereby transporting the hydraulic oil between the internal it reservoir 50 and the cylinder 71 via the plunger 44.

With the thus-configured buoyant force adjustment mechanism 30A, a buoyant force is adjusted as follows. That is, the hydraulic oil is carried from the internal oil reservoir 50 to the cylinder 71 during the ascent. At first, the drive motor 41 is operated to move the plunger 44 in the X-direction in FIG. 3. At this time, the first two-way valve 92 is opened and the second two-way valve 93 is closed so that the hydraulic oil is carried from the internal oil reservoir 50 to the plunger 44. Subsequently, the drive motor 41 is operated to move the plunger 44 in the Y-direction in FIG. 3. At this time, the first two-way valve 92 is closed and the second two-way valve 93 is opened so that the hydraulic oil is carried from the plunger 44 to the cylinder 71 and the buoyant force adjustment piston 72 moves outward. In this way, the hydraulic oil is carried between the internal oil reservoir 50 and the cylinder 71 via the plunger 44.

Accordingly, a buoyant force increases and the float hull 11 slightly ascends. The same operations are repeated so that the amount of hydraulic oil inside the cylinder 71 increases and the float hull 11 ascends to a predetermined position.

On the other hand, during the descent, the hydraulic oil is carried from the cylinder 71 to the internal oil reservoir 50. At first, the drive motor 41 is operated to move the plunger 44 in the X-direction in FIG. 3. At this time, the first two-way valve 92 is closed and the second two-way valve 93 is opened so that the hydraulic oil is carried from the cylinder 71 to the plunger 44 and the buoyant force adjustment piston 72 moves inward. Accordingly, a buoyant force decreases. Subsequently, the drive motor 41 is operated to move the plunger 44 in the Y-direction in FIG. 3. At this time, the first two-way valve 92 is opened and the second two-way valve 93 is closed so that the hydraulic oil is carried from the plunger 44 to the internal oil reservoir 50.

The same operations are repeated so that the amount of hydraulic oil inside the cylinder 71 decreases and the float hull 11 descends to a predetermined position.

Also with the buoyant force adjustment mechanism 30A according to the present variant, a buoyant force can be adjusted similarly to the buoyant force adjustment mechanism 30 and thus similar effects can be obtained.

The present invention is not limited to the embodiment. For example, the ocean observation float device has been described in the above example, but any float devices for adjusting a buoyant force of the float hull may be applied to other use, not limited to measurement. Additionally, the embodiment can be variously modified without departing from the spirit of the present invention.

According to the present invention, it is possible to provide a float device capable of reducing the number of parts and controlling a buoyant force with high accuracy during both ascent and descent.

What is claimed is:

1. A float device comprising:

a float hull having a certain buoyancy;

a drive motor provided inside the float hull;

a plunger reciprocating along with rotation of the drive motor;

an internal oil reservoir for storing an hydraulic oil therein;

a variable volume body attached to the float hull and opened to the outside;

a buoyant force adjustment piston reciprocating in the variable volume body along with exit/entry of the hydraulic oil; and a three-way valve having a first connection port connected to the plunger, a second connection port connected to the internal of reservoir and a third connection port connected to the variable volume body, for switching the flow between the first connection port and the second connection post and the flow between the first connection port and the third connection port.

2. The float device according to claim 1, wherein the three-way valve is switched to cause the first connection port and the second connection port to permit flow during the movement of the plunger to one side and the three-way valve is switched to cause the first connection port and the third connection port to permit flow during the movement of the plunger to the other side, thereby carrying the hydraulic oil between the internal oil reservoir and the variable volume body.

3. The float device according to claim 1, wherein an ocean data measurement electronic device is provided inside the float hull.

4. The float device according to claim 1, wherein a working robot is provided in the float hull.

5. The float device according to claim 1, wherein the variable volume body is a cylinder.

6. The float device according to claim 1, wherein the variable volume body is a bladder.

7. The float device comprising:

a float hull having a certain buoyancy;

a drive motor provided inside the float hull;

a plunger reciprocating along with rotation of the drive motor;

an internal oil reservoir for storing an hydraulic oil therein;

a variable volume body attached to the float hull and opened to the outside;

a buoyant force adjustment piston reciprocating in the variable volume body along with exit/entry of the hydraulic oil;

a branch pipe connected at the branch point to the plunger;

a first two-way valve attached to one side of the branch pipe and connected to the internal oil reservoir; and a second two-way valve attached to the other side of the branch pipe and connected to the variable volume body.

8. The float device according to claim 7, wherein the first two-way valve is opened and the second two-way valve is closed during the movement of the plunger to one side and the first two-way valve is closed and the second two-way valve is opened during the movement of the plunger to the other side so that the hydraulic oil is carried between the internal oil reservoir and the variable volume body via the plunger.

9. The float device according to claim 7, wherein an ocean data measurement electronic device is provided inside the float hull.

10. The float device according to claim 7, wherein a working robot is provided in the float hull.

11. The float device according to claim 7, wherein the variable volume body is a cylinder.

12. The float device according to claim 7, wherein the variable volume body is a bladder.

* * * * *

UNITED STATES PATENT AND TRADEMARK OFFICE

CERTIFICATE OF CORRECTION

PATENT NO. : 8,601,969 B2
APPLICATION NO. : 13/456260
DATED : December 10, 2013
INVENTOR(S) : K. Watanabe et al.

It is certified that error appears in the above-identified patent and that said Letters Patent is hereby corrected as shown below:

On the Title Page

| COLUMN | LINE | ERROR |
|---|---|---|
| (57) Pg. 1, col. 2 | Abstract 9 of text | "per" should read --port-- |

In the Claims

| | | |
|---|---|---|
| 6 (Claim 1, | 9 line 14) | "of" should read --oil-- |
| 6 (Claim 1, | 12 line 17) | "post" should read --port-- |

Signed and Sealed this
Eighteenth Day of August, 2015

Michelle K. Lee

Michelle K. Lee
*Director of the United States Patent and Trademark Office*